US010979816B2

(12) United States Patent
Feng

(10) Patent No.: US 10,979,816 B2
(45) Date of Patent: Apr. 13, 2021

(54) SPEAKER

(71) Applicant: AAC Technologies Pte. Ltd., Singapore (SG)

(72) Inventor: Dai Feng, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/526,931

(22) Filed: Jul. 30, 2019

(65) Prior Publication Data

US 2020/0045446 A1 Feb. 6, 2020

(30) Foreign Application Priority Data

Aug. 3, 2018 (CN) ..... 201821245812.2

(51) Int. Cl.

| | |
|---|---|
| ***H04R 9/04*** | (2006.01) |
| ***H04R 9/02*** | (2006.01) |
| ***H04R 1/06*** | (2006.01) |
| ***H04R 9/06*** | (2006.01) |
| ***H04R 7/12*** | (2006.01) |
| ***H04R 7/16*** | (2006.01) |

(52) U.S. Cl.

CPC ..... *H04R 9/043* (2013.01); *H04R 1/06* (2013.01); *H04R 7/127* (2013.01); *H04R 7/16* (2013.01); *H04R 9/025* (2013.01); *H04R 9/06* (2013.01); *H04R 2400/11* (2013.01)

(58) Field of Classification Search

CPC ... H04R 7/16; H04R 7/18; H04R 9/02; H04R 2499/11; H04R 2400/11; H04R 9/025; H04R 9/043; H04R 9/06; H04R 7/02; H04R 1/02; H04R 9/046; H04R 7/04; H04R 2209/024

See application file for complete search history.

(56) References Cited

U.S. PATENT DOCUMENTS

| | | | | |
|---|---|---|---|---|
| 9,992,576 | B2 * | 6/2018 | Bae | H04R 7/26 |
| 2011/0123061 | A1 * | 5/2011 | Kamimura | H04R 9/025 381/412 |
| 2011/0293133 | A1 * | 12/2011 | Yan | H04R 9/063 381/401 |
| 2012/0106775 | A1 * | 5/2012 | Shao | H04R 9/043 381/412 |
| 2013/0133975 | A1 * | 5/2013 | Kim | H04R 9/06 181/166 |
| 2014/0056465 | A1 * | 2/2014 | Li | H04R 9/025 381/400 |

(Continued)

*Primary Examiner* — Oyesola C Ojo

(74) *Attorney, Agent, or Firm* — W&G Law Group LLP

(57) ABSTRACT

Provided is a speaker, including a holder, a vibration unit, and a magnetic circuit unit. The vibration unit includes a first diaphragm and a voice coil, and the voice coil includes a voice coil lead wire. A centering support is sandwiched between the first diaphragm and the voice coil, and includes a first pad portion. The magnetic circuit unit has a recessed portion formed at a position corresponding to the first pad portion. In the speaker provided by the present disclosure, the magnetic circuit unit is provided with the recessed portion to increase the distance between the magnetic circuit unit and the first pads, so that the vibration amplitude of the voice coil can be increased, thereby improving the acoustic performance of the speaker, and providing operating space for the subsequent welding process.

10 Claims, 5 Drawing Sheets

(56) References Cited

U.S. PATENT DOCUMENTS

| | | | | |
|---|---|---|---|---|
| 2014/0153771 | A1* | 6/2014 | Ohashi | H04R 9/06 381/412 |
| 2014/0169593 | A1* | 6/2014 | Kwon | H04R 9/043 381/185 |
| 2014/0241566 | A1* | 8/2014 | Choi | H04R 9/043 381/400 |
| 2014/0254858 | A1* | 9/2014 | He | H04R 25/554 381/398 |
| 2015/0189442 | A1* | 7/2015 | Zhang | H04R 9/025 381/409 |

* cited by examiner

SPEAKER

TECHNICAL FIELD

The present disclosure relates to the acoustoelectric field, and in particular, to a speaker.

BACKGROUND

With the development of electronic technology, in order to adapt to the multi-functional and high sound quality requirements of various audio equipment and information communication equipment, higher requirements are raised for the acoustic performance of a speaker.

In the related art, a centering support and a voice coil of the speaker are welded and fixed to one another through a first pad portion, and the first pad is arranged opposite to a main pole core such that a distance between the centering support and the main pole core is reduced. During the vibration of the voice coil, in order to prevent the centering support from contacting the main pole core, the vibration amplitude of the voice coil must be reduced, which limits the improvement on the acoustic performance of the speaker. Meanwhile, the distance between the centering support and the main pole core is too small to facilitate the subsequent welding process, thereby affecting the good rate of the speaker product.

Therefore, it is urgent to provide a speaker to solve the above technical problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present invention will be further illustrated with reference to the accompanying drawings and the embodiments.

Figure 1:
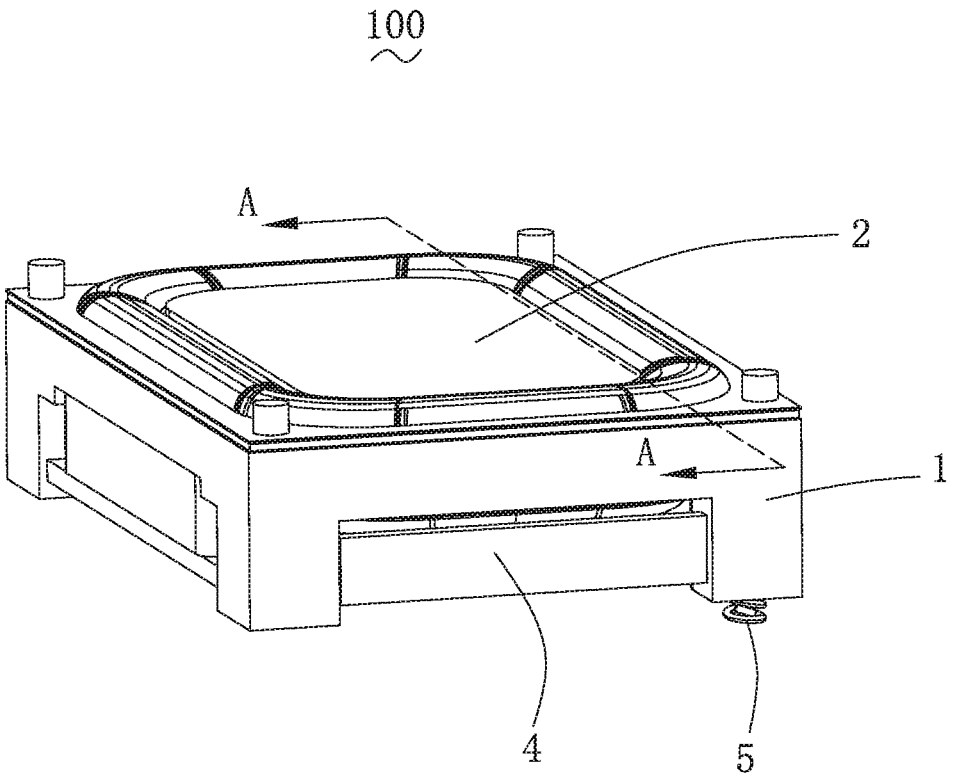
FIG. 1 is a perspective structural schematic diagram of a speaker according to the present disclosure.
Figure 2:
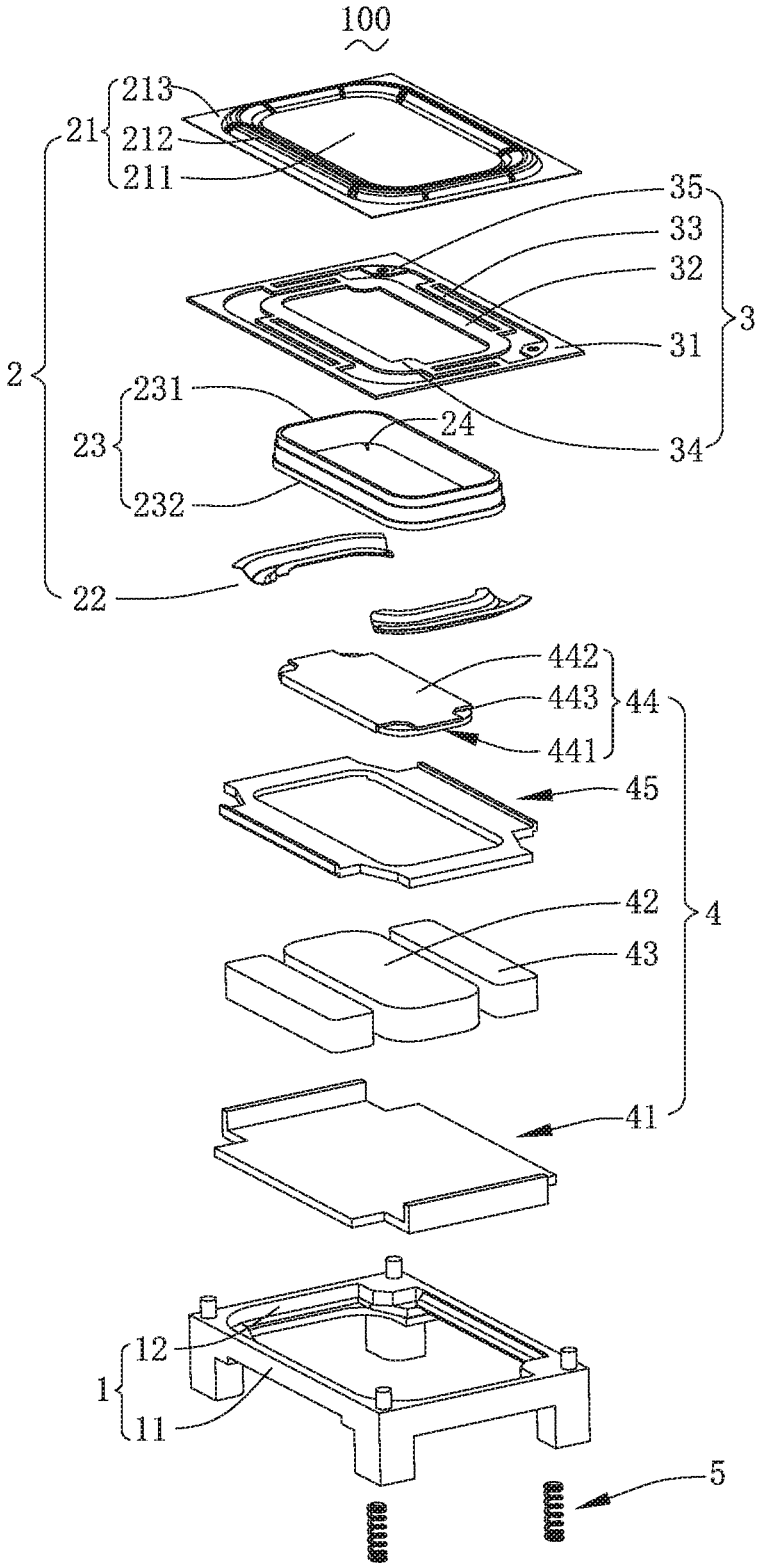
FIG. 2 is an exploded view of the speaker as shown in FIG. 1.
Figure 3:
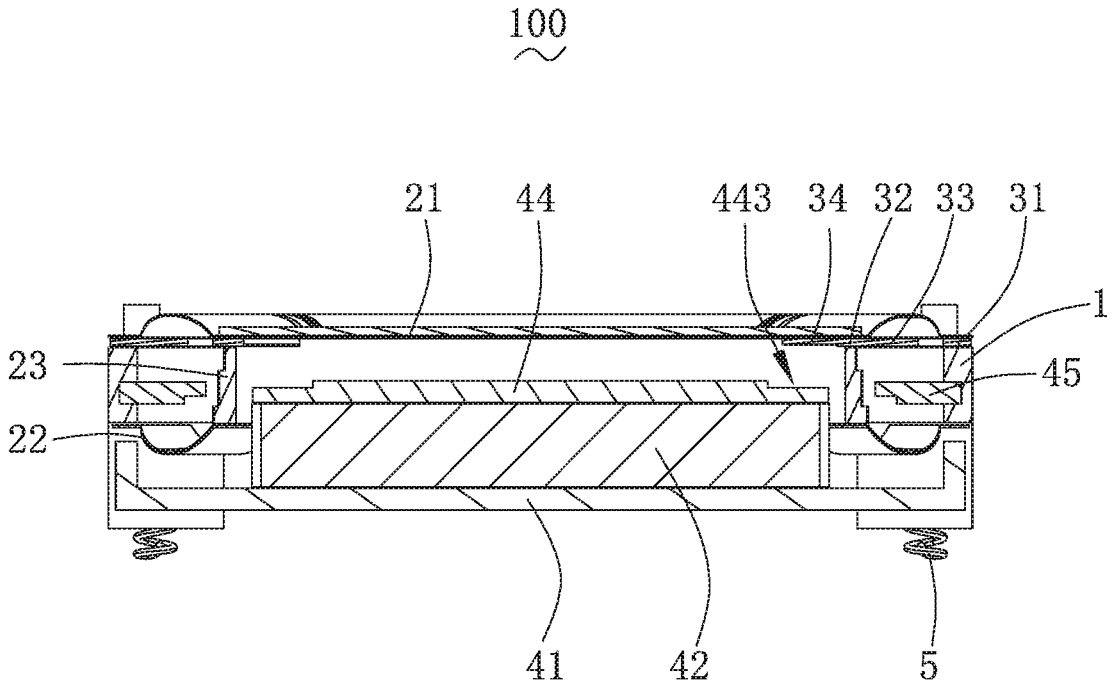
FIG. 3 is a cross-sectional view of the speaker taken along line A-A as shown in FIG. 1.

With reference to FIG. 1 to FIG. 3, the present disclosure provides a speaker 100. The speaker 100 includes a holder 1 having a receiving space, a vibration unit 2 received in the receiving space, a centering support 3 for elastically supporting the vibration unit 2, a magnetic circuit unit 4 configured to drive the vibration unit 2 to vibrate and emit sound, and conductive terminals 5 electrically connected to the vibration unit 2.

The holder 1 is configured to receive and protect other devices of the speaker 100.

The holder 1 is has a shape of a rectangular frame, and includes two long side walls 11 spaced apart from each other in parallel, and two short side walls 12 arranged at two ends of the two long side walls 11 and respectively connected to the two long side walls 11. The long side walls 11 and the short side walls 12 are integrally formed, and cooperate to form the receiving space of the holder 1.

The vibration unit 2 is configured to vibrate and emit sound. For example, the vibration unit 2 includes a first diaphragm 21 configured to vibrate and emit sound, a second diaphragm 22 arranged opposite to the first diaphragm 21, and a voice coil 23 connected to the second diaphragm 22 and configured to drive the first diaphragm 21 to vibrate and emit sound. The voice coil includes a voice coil lead wire 24. The second diaphragm 22 is configured to intensify the vibration of the first diaphragm 21, and may prevent polarization of the first diaphragm 21, thereby improving the acoustic performance of the speaker 100.

The first diaphragm 21 includes a dome portion 211 arranged opposite to the voice coil 23, a suspension portion 212 connected to the dome portion 211, and a fixed portion 213 fixedly connected to the suspension portion 212. For example, the cross-section of the suspension portion 212 is of an arc-shaped structure protruding in a direction facing away from the holder 1, and the suspension portion 212 is circularly arranged around the dome portion 211 and connected to the dome portion 211 with the fixed portion 213. The dome portion 211 is configured to intensify the vibration of the first diaphragm 21.

The voice coil 23 includes a first surface 231 adjacent to the first diaphragm 21 and a second surface 232 arranged opposite to the first surface 231. The centering support 3 is attached to the first surface 231, and the second diaphragm 22 is attached to the second surface 232.

The centering support 3 is sandwiched between the first diaphragm 21 and the voice coil 23.

Figure 4:
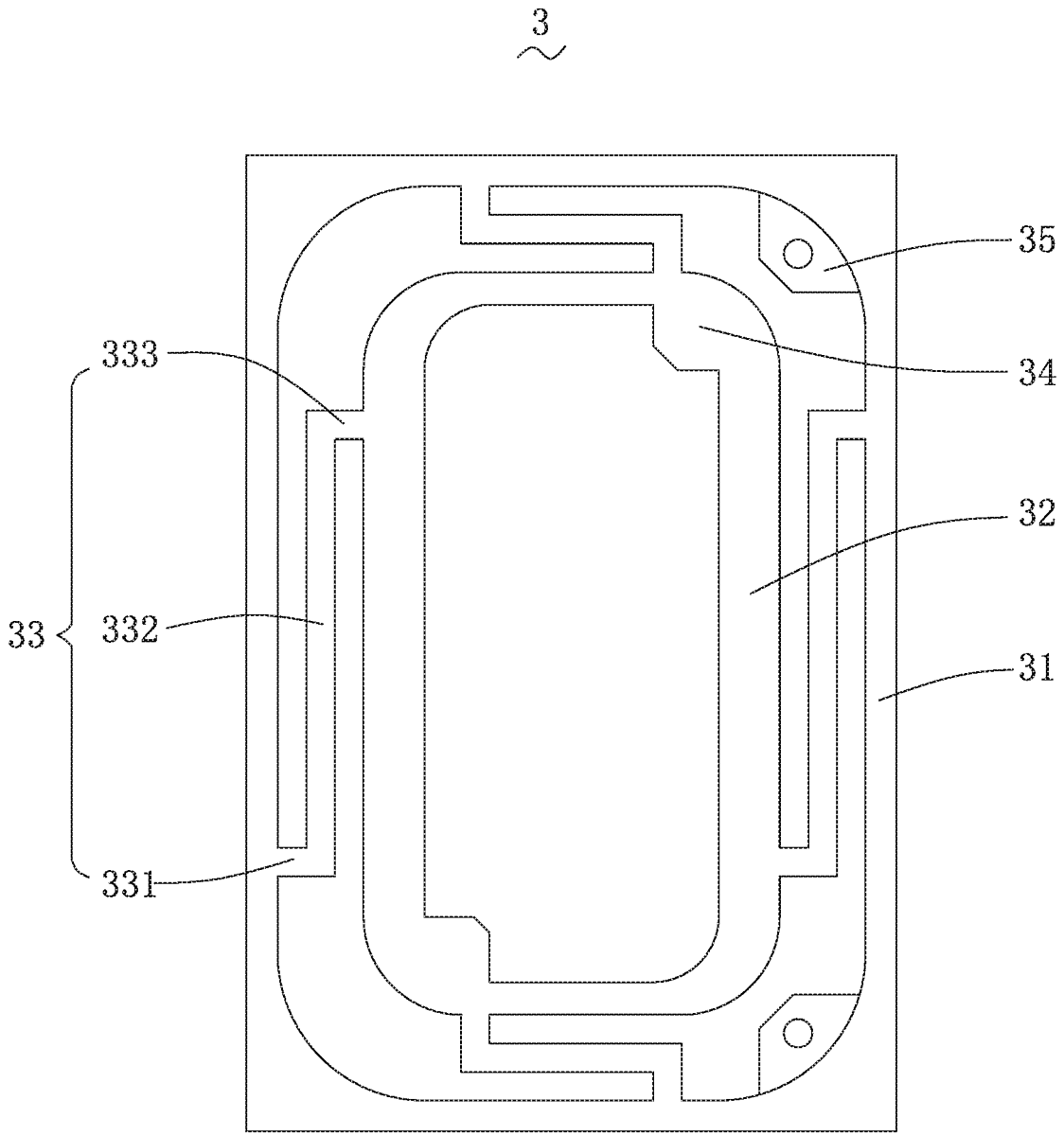
FIG. 4 is a front view of a centering support as shown in FIG. 2.

With reference to FIG. 4, the centering support 3 includes an outer ring 31 fixedly connected to the holder 1, an inner ring 32 spaced apart from the outer ring 31 and connected to the voice coil 23, a plurality of connecting arms 33 for connecting the inner ring 32 with the outer ring 31, first pad portions 34 extending from the inner ring 32 away from the outer ring 31, and second pad portions 35 extending from the outer ring 31 in a direction facing towards the inner ring 32.

For example, the inner ring 32 is sandwiched between the dome portion 211 and the voice coil 23, the outer ring 31 is sandwiched between the fixed portion 213 and the holder 1, and the centering support 3 and the voice coil 23 are fixedly connected to each other through the first pad portions 34. For example, the centering support 3 and the voice coil lead wire 24 are fixedly connected to each other by spot welding. The centering support 3 and the holder 1 are fixedly connected to each other through the second pad portions 35.

Further, the outer ring 31 and the inner ring 32 both are a rectangular frame structure, and the inner ring 32 is spaced apart from the outer ring 31 and is circularly arranged at the inner side of the outer ring 31. The number of the first pad portions 34 is two, and the two first pad portions 34 are symmetrically arranged along a diagonal line of the inner ring 32 to maintain stability and balancing of connection between the centering support 3 and the voice coil 23. The number of the second pad portions 35 is also two, and the two second boding pad portions 35 are arranged at the corners of the outer ring 31 and symmetrically arranged with respect to a central axis in a longitudinal direction of the speaker 100.

The connecting arms 33 are suspended in the receiving space, and the number thereof is four. The four connecting arms 33 are fixedly and firmly connected to the four sides of the inner ring 32 and the four sides of the outer ring 31. Furthermore, the centering support 3 is a flexible circuit board, and the connecting arm 33 is made of an elastic material, so that the vibration amplitude of the voice coil 23 can be adjusted and the acoustic performance of the speaker 100 can be improved.

The connecting arm 33 includes a first portion 331 extending from the outer ring 31 in a direction facing towards the inner ring 32, a second portion 332 bent and extending from an end of the first portion 331 facing away from the outer ring 31, and a third portion 333 bent and extending from an end of the second portion 332 facing away from the first portion 331 and connected to the inner ring 32. The first portion 331, the second portion 332 and the third portion 333 are formed into one piece.

The connecting arm 33 is formed by multiple times of bending, thereby increasing the elasticity of the connecting arm 33.

The magnetic circuit unit 4 is configured to drive the vibration unit 2 to vibrate and emit sound. For example, the magnetic circuit unit 4 includes a yoke 41 fixedly connected to the holder 1, a main magnet 42 assembled at the center of the yoke 41, auxiliary magnets 43 assembled on the yoke 41 and surrounding the main magnet 42 to form magnetic gaps, a main pole core 44 attached above the main magnet 42, and an auxiliary pole core 45 attached to the auxiliary magnets.

In the embodiment, the yoke 41 is of a bowl-shaped structure, the main magnet 42 is attached to the center of the yoke 41, the auxiliary magnet 43 is in a long-strip shape, and the number thereof is two. The two auxiliary magnets 43 are symmetrically arranged at two sides of the main magnet 42. The main magnet 42 and the auxiliary magnets 43 are spaced apart to form the magnetic gaps, and the voice coil 23 is suspended in the magnetic gaps.

The main pole core 44 and the auxiliary pole core 45 are made of a permeability magnetic material and thus have a permeability magnetic function.

The main pole core 44 includes a lower surface 441 attached to the main magnet 42, an upper surface 442 arranged opposite to the lower surface, and recessed portions 443 formed by recessing from the upper surface 442 towards the lower surface 441. The upper surface 442 is spaced apart from the centering support 3 in parallel, and the recessed portion 443 is arranged the positions corresponding to positions where the first pad portions 34 are located.

For example, the number of the recessed portions 443 is four, and every two of the four recessed portions 443 are symmetrically arranged at the corners of the main pole core 44. Further, the recessed portion 443 has a cross-sectional area greater than or equal to that of the first pad portion 34.

Figure 5A:
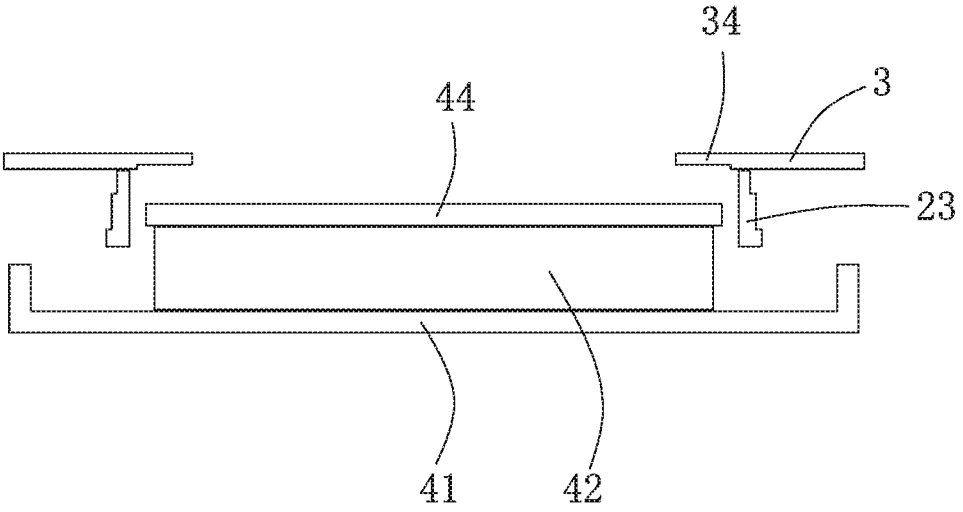
FIG. 5A is a schematic diagram showing a positional relationship between first pad portions and a main pole core in the speaker of the related art.

With reference to FIG. 5A, in the related art, a distance between the centering support 3 and the main pole core 44 is reduced due to the presence of the first pad portions 34. The centering support 3 is connected to the voice coil 23. During the vibration of the voice coil 23, in order to prevent the centering support 3 from contacting the main pole core 44, the vibration amplitude of the voice coil 23 must be reduced, which restricts the improvement on the acoustic performance of the speaker 100. Meanwhile, the distance between the centering support 3 and the main pole core 44 is too small to facilitate the subsequent welding process, thereby affecting the product good rate of the speaker 100.

Figure 5B:
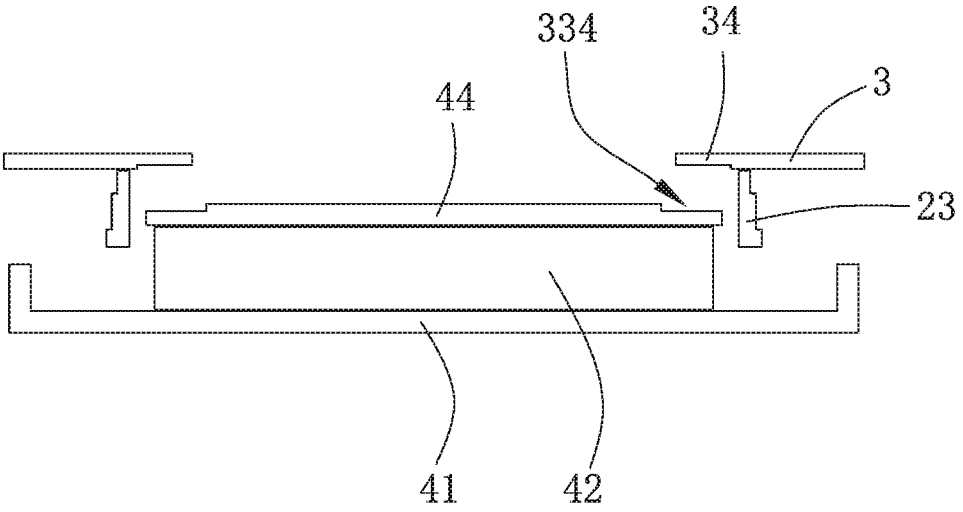
FIG. 5B is a schematic diagram showing a positional relationship between first pad portions and a main pole core in the speaker of the present disclosure.

With reference to FIG. 5B, in the present disclosure, the recessed portion 443 is arranged opposite to the first pad portion 34, and the recessed portion 443 is formed by being recessed from the upper surface 442 of the main pole core 44. The recessed portion 443 forms an avoidance position with respect to the first pad portion 34. That is, at a position corresponding to the recessed portion 443, the distance between the main pole core 44 and the first pad portion 34 is increased, so that the vibration amplitude of the centering support 3 can be increased, and the vibration amplitude of the voice coil 23 can be increased, thereby improving the acoustic performance of the speaker 100. Meanwhile, the increased distance can also ensure a sufficient operating space for subsequent welding process, and thus improve the success rate of welding and the good rate of the product. Furthermore, the number of the recessed portions 443 is four, and the assembly of the main pole core 44 can also be facilitated.

The conductive terminals 5 are fitted in the holder 1 and configured to electrically connect the voice coil 23 with the outside. Further, the conductive terminals 5 are electrically connected to the centering support 3.

Compared with the related art, in the speaker 100 provided by the present disclosure, the main pole core 44 is provided with the recessed portions 443 at positions corresponding to the first pad portions 34 of the centering support 3 to increase the distance between the main pole core 44 and the first pads 34, so that the vibration amplitude of the voice coil 23 can be increased, and further the vibration amount of the vibration unit 2 is increased, thereby improving the acoustic performance of the speaker 100; meanwhile, the operating space is provided for the subsequent welding process, thereby improving the good rate of the product.

The above merely are the embodiments of the present disclosure, and it should be noted that those skilled in the art also can make improvements, without departing from the creative conception of the present disclosure, which all shall fall within the scope of the present disclosure.

What is claimed is:

1. A speaker, comprising:

a holder having a receiving space;

a vibration unit received in the receiving space;

a magnetic circuit unit received in the receiving space and configured to drive the vibration unit to vibrate and emit sound; and a centering support, wherein the vibration unit comprises a first diaphragm configured to vibrate and emit sound, and a voice coil located below the first diaphragm and configured to drive the first diaphragm to vibrate and emit sound, the voice coil comprising a voice coil lead wire, the centering support is sandwiched between the first diaphragm and the voice coil, and the centering support comprises a first pad portion connected to the voice coil lead wire, and a second pad portion connected to the holder, the voice coil is electrically connected to an external circuit through the centering support, and the magnetic circuit unit has a recessed portion formed at a position corresponding to the first pad portion, the recessed portion having a shape matching that of the first pad portion.

2. The speaker as described in claim 1, wherein the magnetic circuit unit comprises:

a yoke fixedly connected to the holder;

a main magnet assembled at a center of the yoke;

auxiliary magnets assembled on the yoke and surrounding the main magnet to form magnetic gaps;

a main pole core attached onto the main magnet; and an auxiliary pole core attached to the auxiliary magnets, the recessed portions being formed in the main pole core.

3. The speaker as described in claim 2, wherein the main pole core comprises a lower surface attached to the main magnet, and an upper surface arranged opposite to the lower surface, the upper surface is spaced apart from and in parallel with the centering support, and the recessed portion is formed by recessing from the upper surface towards the lower surface.

4. The speaker as described in claim 3, wherein four recessed portions are provided, and every two of the four recessed portions are symmetrically arranged at corners of the main pole core.

5. The speaker as described in claim 1, wherein the recessed portion has a cross-sectional area greater than or equal to that of the first pad portion.

6. The speaker as described in claim 1, wherein the centering support further comprises an outer ring fixedly connected to the holder, an inner ring spaced apart from the outer ring and connected to the voice coil, and a plurality of connecting arms for connecting the outer ring with the inner ring, the first pad portion is formed by extending from the inner ring in a direction facing away from the outer ring, and the second pad portion is formed by extending from the outer ring in a direction facing towards the inner ring.

7. The speaker as described in claim 6, wherein the inner ring is a rectangular frame structure, two first pad portions are provided, and the two first pad portions are symmetrically arranged along a diagonal line of the inner ring.

8. The speaker as described in claim 6, wherein the outer ring is a rectangular frame structure, two second pad portions are provided, and the two second pad portions are arranged at corners of the outer ring and located at a side of the speaker in a length direction.

9. The speaker as described in claim 6, wherein a number of the plurality of connecting arms is four, each of four sides of the centering support is provided with one of the plurality of connecting arms, each of the plurality of connecting arms has one end connected to the inner ring, and another end connected to the outer ring.

10. The speaker as described in claim 6, wherein each of the plurality of connecting arms comprises a first portion extending from the outer ring in the direction facing towards the inner ring, a second portion bent and extending from an end of the first portion facing away from the outer ring, and a third portion bent and extending from an end of the second portion facing away from the first portion and connected to the inner ring, the first portion, the second portion and the third portion being formed into one piece.

* * * * *